US006234309B1

(12) United States Patent
Aikio

(10) Patent No.: US 6,234,309 B1
(45) Date of Patent: May 22, 2001

(54) BOTTLE PACKAGE

(75) Inventor: Veijo Aikio, Vantaa (FI)

(73) Assignee: OYJ Hartwall ABP, Helsinki (FI)

( * ) Notice: Subject to any disclaimer, the term of this patent is extended or adjusted under 35 U.S.C. 154(b) by 0 days.

(21) Appl. No.: 09/509,772

(22) PCT Filed: Sep. 29, 1998

(86) PCT No.: PCT/FI98/00769

§ 371 Date: Jun. 14, 2000

§ 102(e) Date: Jun. 14, 2000

(87) PCT Pub. No.: WO99/16680

PCT Pub. Date: Apr. 8, 1999

(30) Foreign Application Priority Data

Oct. 1, 1997 (FI) ..... 973858

(51) Int. Cl.[7] ..... B65D 75/00

(52) U.S. Cl. ..... 206/427; 206/141; 206/201; 220/519

(58) Field of Search ..... 206/427, 431, 206/141, 162, 139, 145, 201, 203, 509–511; 220/514, 515, 519; 294/87.2

(56) References Cited

U.S. PATENT DOCUMENTS

| | | | | |
|---|---|---|---|---|
| 3,693,830 | * | 9/1972 | Oglesbee | 206/162 |
| 3,888,348 | * | 6/1975 | Frey | 206/427 |
| 3,913,778 | * | 10/1975 | Oglesbee | 206/427 |
| 3,951,259 | * | 4/1976 | Oglesbee | 206/427 |
| 4,130,200 | * | 12/1978 | Iepson et al. | 206/427 |
| 4,204,617 | | 5/1980 | Hirota . | |
| 4,560,064 | * | 12/1985 | Peterson et al. | 294/87.2 |

FOREIGN PATENT DOCUMENTS

| | | |
|---|---|---|
| 0 604 863 | 7/1994 | (EP) . |
| WO 96/09220 | 4/1996 | (WO) . |
| WO 97/18141 | 5/1997 | (WO) . |

* cited by examiner

*Primary Examiner*—Luan K. Bui
(74) *Attorney, Agent, or Firm*—Young & Thompson

(57) ABSTRACT

A bottle package which allows bottles to be transported by carrying them, the bottles including a bottom, body, neck and mouth, of which the neck includes a projecting annular collar, the package including a base for receiving and supporting the bottoms of the bottles, the base including a seat for each bottle to be placed on the base, and a frame and a handle which are attached to the base and enable carrying of the package.

8 Claims, 2 Drawing Sheets

BOTTLE PACKAGE

BACKGROUND OF THE INVENTION

This invention relates to a bottle package which allows bottles to be transported by carrying them, the bottles comprising a bottom, body, neck and mouth, of which the neck comprises a projecting annular collar, the package comprising a base for receiving and supporting the bottoms of the bottles, the base comprising a seat for each bottle to be placed on the base, and a frame and a handle which are attached to the base and enable carrying of the package.

The above described packages which allow bottles to be carried have typically been different crates which have been carried by holding either the handles on the sides of the crate or the grip or handle provided in the middle of the crate. The most significant advantage of such crate-like packages has been the fact that they can be stacked one on top of the other and thus the crates can be transported from the producer to the retailer for example by stacking the crates on pallets. Such crates are rather practical when the size of the bottles to be placed therein is for example 0.33 or 0.5 liters, in which case the number of the bottles to be placed in the package is 24 or 16, respectively, the packaged liquid weighing approximately 8 kg. Such crate-like carrier packages are, however, out of the question when bottles of 1 liter or larger are used. Nowadays bottles of 1.5 liters are rather common and their transportation from the producer to the retailer in crates which could be stacked one on top of the other and which the consumer could also carry is not practical. In that case only 4 to 6 bottles could be placed in the crate, and thus the number of crate-like packages would be unreasonably large compared to the amount of goods to be delivered. Furthermore, the height of the bottles of 1.5 liters is such that it would be difficult to carry the crate needed for them.

BRIEF DESCRIPTION OF THE INVENTION

The object of the present invention is to provide a package the structure of which is so light that for example 4 bottles of 1.5 liters can be packed in it and which can nevertheless be stacked on top of other packages for transportation on pallets. This object is achieved with a package of the invention which is characterized in that on the surface opposite to the bottle seats the base of the package supporting the bottles comprises sockets for receiving the mouths of the bottles and possible caps up to the annular collar of the bottle neck, the sockets being arranged centrally with respect to the bottle seats, whereby the packages stacked one on top of the other rest on the collars of the bottles in the lower layer of packages. Thus in the package of the invention the weight of the bottles is no longer received through the sides of the crate like in the conventional bottle crates, but the collars of the bottles in the lower layer receive the weight of the upper packages when the packages are stacked one on top of the other. Such collars are typically used in plastic recyclable bottles known as RefPET bottles. The annular collar round the bottle neck is a conventional component of a bottle of this kind, the collar being utilized in the different handling steps of the bottle, such as washing, filling and packing for transportation.

In a preferred embodiment of the package of the invention the socket for receiving the bottle mouth and a possible cap comprises a sleeve. The sleeve edge away from the bottle seat forms a countersurface to the annular collar of the bottle neck. The sleeve preferably comprises an opening on the side of the bottle seat, which renders the package lighter and facilitates cleaning of it. The sleeve may also be conical, tapering towards the bottle seat. This conical shape helps to guide the mouths of the bottles to their sockets.

In order that the package of the invention would be as practical a carrier package as possible and that the bottles placed therein would reliably stay in their seats when the package is carried, the package of the invention is further characterized in that the package comprises a lid which is attached to the frame and handles and is substantially parallel to the base at the height of the bottle necks, the lid being provided with slots which open towards the edge of the lid and receive the bottle necks, and with protrusions at the edges of the slots, the protrusions acting together with the annular collar of the bottle necks and preventing a bottle placed in the package from tilting in the opening direction of the slot. It is also advantageous that the bottle seat of the base comprises means acting together with the bottom of a bottle and preventing a bottle placed in the package from moving in the direction of the plane of the base. Depending on the size of the bottles to be placed in the package one or two or even more bottles can be placed in each slot provided in the lid.

The protrusions preventing a bottle placed in the package from tilting preferably comprise a substantially vertical step in the direction away from the opening direction of the slot. This allows a bottle placed in the package to be removed only by slightly lifting the bottle, whereby its neck and the annular collar can move over the edges of the protrusions of the slot in the opening direction of the slot. Instead, the protrusions may preferably become lower in the opening direction of the slot like ramps. This facilitates placing of a bottle in its seat since after the bottle bottom has been placed on the base, the bottle being in a tilted position, the collar of the bottle neck can be made to slide over the ramp-like protrusion behind the protrusion simply by pushing the bottle into an upright position.

BRIEF DESCRIPTION OF THE DRAWINGS

In the following the package of the invention will be described in greater detail with reference to the accompanying drawing, in which.

DETAILED DESCRIPTION OF THE INVENTION

Figure 1:
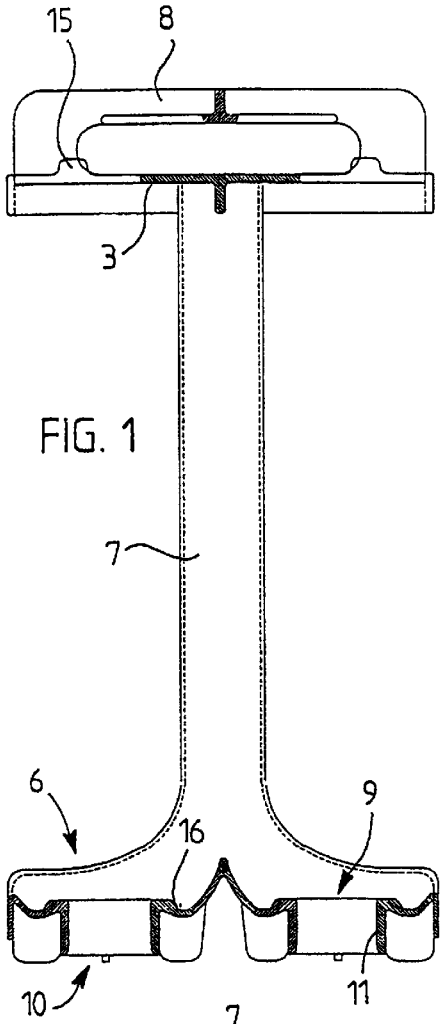
FIG. 1 is a vertical cross section of a preferred embodiment of the package of the invention.

FIG. 1 is a vertical cross section of a preferred embodiment of the package of the invention. The same package can also be seen in FIGS. 2 and 3. This package is intended for four bottles, which appears from FIGS. 2 and 3. For receiving the bottle bottoms the package comprises a base 6, which in turn comprises a seat 9 for each bottle to be placed in the package. The purpose of the base 6 is to support the bottles. As appears from FIGS. 1 and 3, the frame of the package consists of one or more stanchions 7 attached to the base in FIG. 3 there are 3 stanchions. The stanchion in the middle of the package has a substantially quadratic cross section, whereas the stanchions on the sides of the package have a T-shaped cross section. The shape of these stanchions mainly depends on the desired stiffness and on the manufacturing technology. Thus the middle stanchion could have e.g. an X-shaped cross section. The frame formed by the stanchions 7 supports a lid 13 which is provided with slots 14 for receiving the bottle necks. These slots 14 appear particularly from FIG. 2. In the embodiment of FIG. 1 the lid 13 comprises a handle 8 which is formed by two diagonal flaps and enables carrying of the package.

Figure 3:
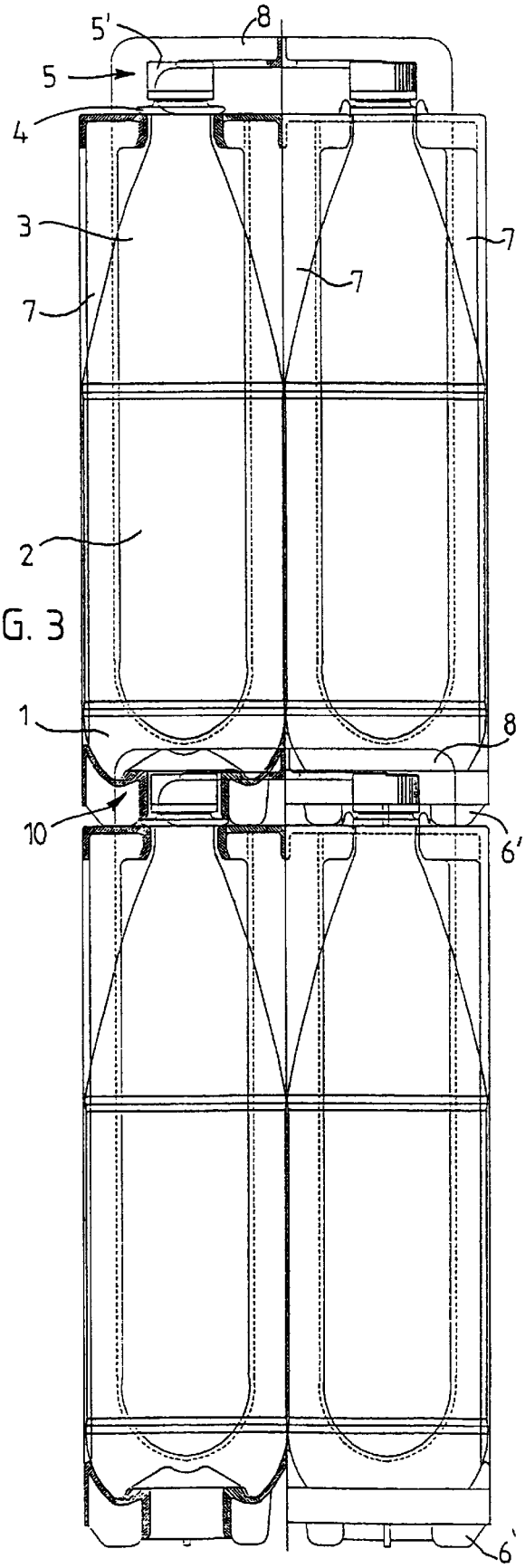
FIG. 3 illustrates two packages of FIG. 1 stacked one on top of the other, the packages being filled with bottles.

It appears from FIG. 3 that the package is intended for bottles which comprise a bottom 1, body 2, neck 3 and mouth 5, which may be provided with a cap 5'. The neck 3 further comprises a protruding annular collar 4. The collar is typically situated at the point where the mouth of the bottle, i.e. the threaded portion of the cap and the bottle neck join, the collar being slightly apart from the threads. This kind of collar is typically used in all RefPET bottles to facilitate the handling of such bottles at a bottling plant. Such plastic recyclable bottles are so light and unstable, especially when empty, that they cannot be transported on a conveyor belt in the upright position like glass bottles.

When a bottle illustrated in FIG. 3 is placed in a package of FIG. 1, the bottle bottom 1 is first placed in the seat 9 provided for it in the base 6. This seat is provided with means, such as a conical protuberance 16 in the middle of the seat like in the embodiment of FIG. 1, the protuberance holding the bottle bottom in its seat in the sideways direction. Such a conical protuberance 16 is suitable for use with bottles the bottoms of which are provided with conical cavities, like the bottle illustrated in FIG. 3. Depending on the structure of the bottle to be used in the package the shape of the bottle seat may be changed accordingly and it can be provided with means, typically with knobs or protuberances, which prevent the bottle from moving sideways, i.e. in the direction of the plane of the base 6 when the bottle is in its seat in the package.

When the bottle has been put in its seat in the base 6, the bottle is pushed into an upright position, whereby its neck 3 is guided to the slot 14 in the lid 13 and the projecting annular collar of the bottle neck settles behind the protrusions 15 at the edges of the slot. These protrusions 15 prevent the bottle from tilting away from the package if the bottle is not first lifted from the base 6. This allows the package to be tilted to a considerable extent without the bottles dropping from the package.

FIG. 1 illustrates one preferred shape of the protrusion 15. It is essential that the surface of the protrusion 15 away from the opening direction of the slot 14 is relatively vertical, i.e. step-shaped, whereby it reliably prevents the bottle from tilting in the opening direction of the slot 14 by means of the collar 4 behind it. In the embodiment of FIG. 1 the edge of the protrusion 15 in the opening direction of the slot is also relatively vertical, which requires that the bottle is slightly lifted from the base 6 when it is placed in its seat. By providing the protrusion 15 with a ramp-like shape in the opening direction of the slot 14 the bottle can be pushed into its place along this ramp without having to lift the bottle. The ramp-like shape of the protrusion in the opening direction of the slot would seem to be the most advantageous solution considering the situation where the consumer puts empty bottles back in the package in order to return the package to a store. In that case bottles slip easily into their seats due to the ramp-like shape of the protrusion and the fact that the lid is slightly flexible.

Naturally the flexibility of the lid may also be utilized when filled bottles are being placed in the package, in which case a bottle can be placed in its seat simply by pushing the bottle in through the slot 14 after the bottle bottom has been lifted onto the base. One essential feature of the package of the invention that should be emphasized here is that the lid 13 does not support the bottles but they rest on the base 6, even though the lid 13 is arranged at such a height that it is located very close to the lower surface of the annular collar 4 of the bottle necks, as appears from FIGS. 3 and 4.

Figure 4:
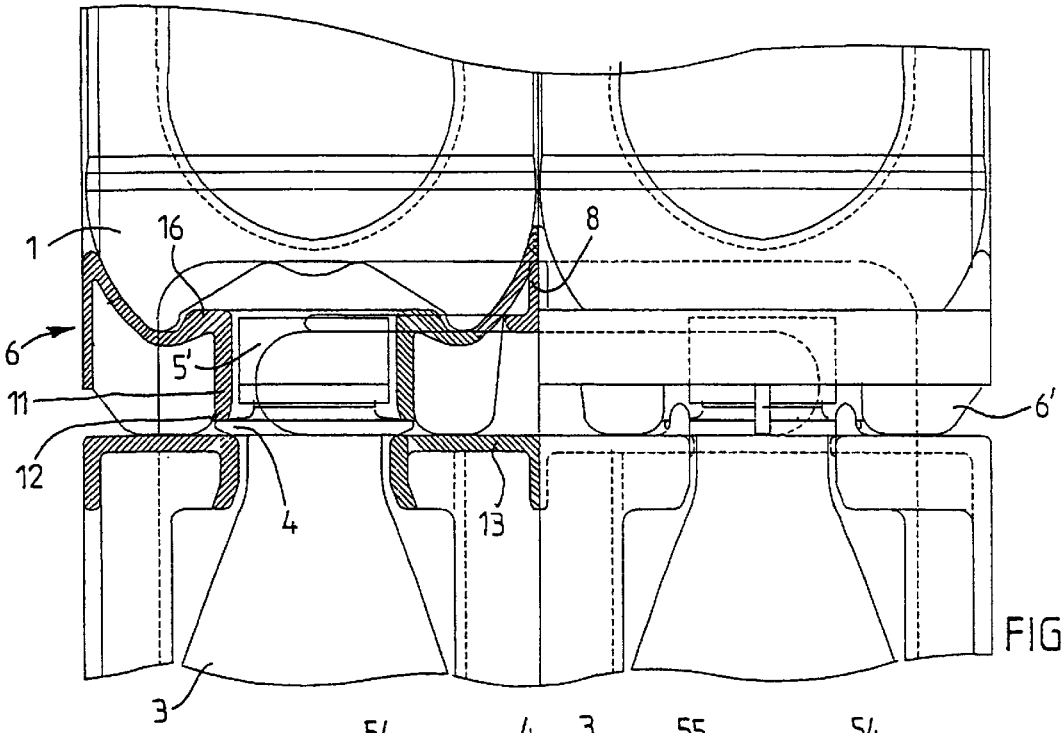
FIG. 4 is a detailed view of how the packages of FIG. 3 rest on each other when stacked one on top of the other.

FIGS. 3 and 4 illustrate a feature which may be the most important one of the package of the invention, i.e. several packages can be stacked one on top of the other without the weight of the package focusing on the frame or handles 7 and 8 of the package. This feature is achieved by providing the base 6 with sockets 10 for receiving the bottle mouths 5 and possible caps 5' up to the annular collar 4 of the bottle necks, the sockets being arranged on the surface away from the bottle seats 9 and centrally with respect to the bottle seats. This appears from FIG. 3 and even better from the partial enlargement of FIG. 4.

According to FIGS. 3 and 4 the socket 10 for receiving the bottle mouth and a possible cap comprises a sleeve 11 whose edge 12 away from the bottle seat 9 forms a countersurface to the annular collar 4 of the bottle neck. Thus when the packages of the invention are stacked one on top of the other in a manner illustrated in FIG. 3, the weight of the upper package is conveyed downwards through the ring or collar 4 round the bottle neck, not through the frame of the package. Thus the packages stacked one on top of the other rest on the collars of the bottles in the lower layer. It should also be noted that the packages stacked one on top of the other are not necessarily aligned but may overlap one another. For example, when packages are piled on a pallet, they are first piled into several towers in which the packages are aligned as illustrated in FIG. 3. Thereafter a smaller number of packages are placed in the upper layer so that they overlap with the packages in the lower layer. Thus the uppermost layer of packages holds the piles or towers of packages stacked on a pallet together.

As it appears from FIG. 4, the sleeves 11 are substantially cylindrical and provided with an opening on the side of the bottle seat 9. This naturally renders the package lighter and facilitates cleaning of it. Alternatively, the cylindrical shape of the sleeves 11 could be replaced with a conical shape tapering towards the bottle seats 9, whereby this conical shape would help to guide and set the bottle mouths 5 or caps 5' to the middle of the socket. It further appears from FIG. 4 that the shape of the lower surface of the package base 6 is such that it can house the handle 8 of the package in the lower layer. As stated above, the handle 8 does not touch the bottom of the base 6 of the lower layer so that it would support the base 6. However, by making the spaces between the handle 8 and the bottom of the base of the upper layer rather small, as illustrated in FIGS. 3 and 4, the packages can be guided easier one on top of the other when they are stacked. On the other hand, this reduces tilting of the package pile or tower especially when the packages contain empty bottles. For the same reason the flange-like pads 6' on the bottom of the base 6 are provided close to the lid 13 of the lower package, as illustrated in FIG. 4. As was stated above, the pads are not intended for supporting the upper package but for preventing it from tilting. The upper surfaces of the handle 8 and the lid 13 and the lower surfaces of the pads 6' function as a kind of guiding surfaces but not as surfaces transmitting the load.

Figure 2:
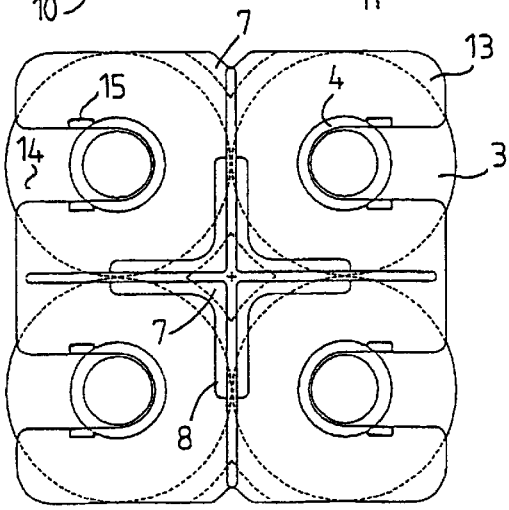
FIG. 2 is a top view of the package of FIG. 1, the package being filled with bottles.
Figure 5:
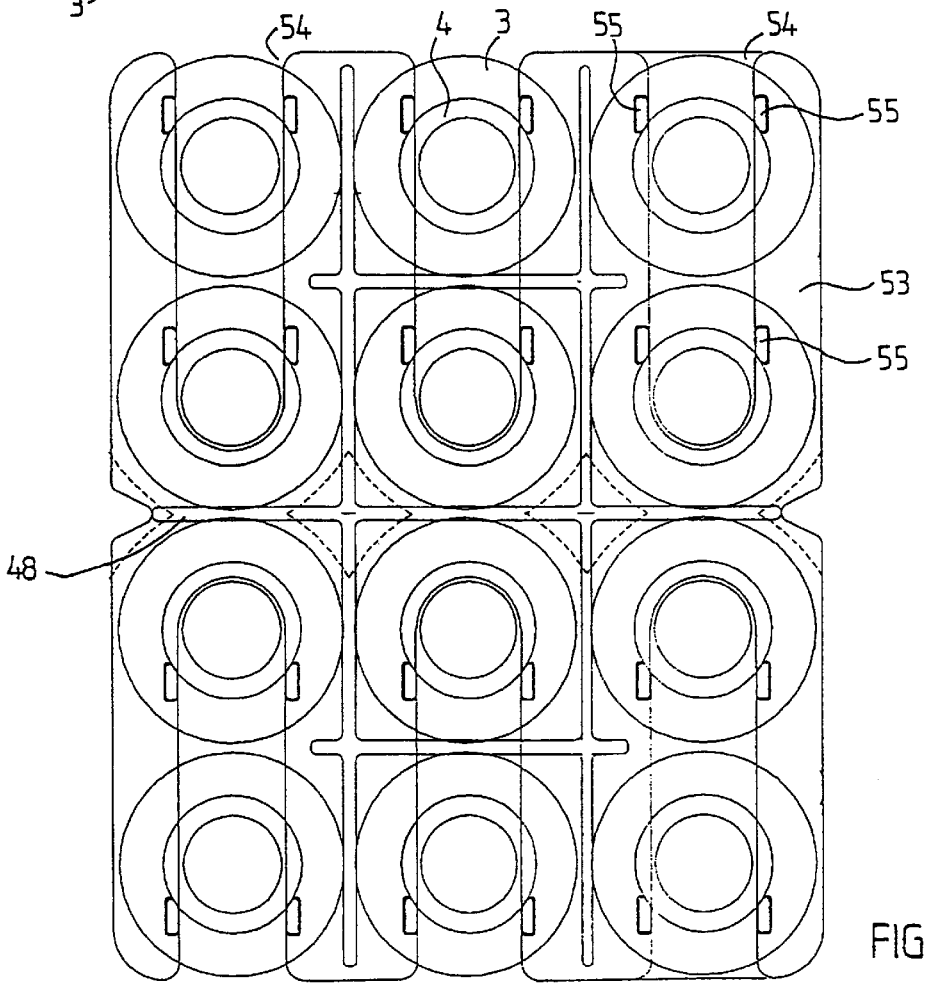
FIG. 5 illustrates a top view of another embodiment of the package of the invention, the package being filled with bottles.

The package shown in FIG. 2 comprises 4 bottles, there being one bottle in each slot 14. FIG. 5 illustrates another embodiment of the package of the invention. In this embodiment there are two bottles placed in the slots 54 of the lid 53 one after the other. Thus there are two successive pairs of protrusions 55 at the edges of the slot 54 in the opening direction of the slot. The base of the package according to FIG. 5 correspondingly comprises two successive bottle seats in the opening direction of the slot 54. Naturally more than two bottles can be placed in one slot, but this would certainly render the package relatively impractical. It is thought that the bottles used in connection with the embodiment of FIG. 5 should be relatively small, e.g. 0.5 liters, whereby the weight of the packaged liquid would be approximately 6 kg.

The package illustrated in FIG. 5 could be modified by removing the bottles that are outermost in the opening direction of the slots, whereby the package would comprise six bottle seats, i.e. there would be one bottle in each slot as in FIG. 2. A package intended for eight bottles could be formed either by placing one bottle in each slot and positioning two packages one after the other according to FIG. 2 or by removing one pair of slots from the package of FIG. 5, whereby there would be two successive bottles in each of the four remaining slots. Thus it is obvious that the package of the invention can be easily modified and dimensioned so that the package can be carried relatively easily regardless of the bottle size to be used. A package comprising only two very large bottles could be easily formed from half of the package of FIG. 2, whereby the bottles are naturally detached from the package in the opposite directions.

Due to its structure the package of the invention can easily be rendered selective so that only certain kind of bottles can be placed in it. This can be achieved first of all by shaping the means that are placed in the bottle seat and act together with the bottle bottom in such a manner with respect to the lower surface of the bottom and the diameter of the bottom that the bottle seat is not suitable for receiving bottles shaped or dimensioned otherwise. Secondly, by adjusting the height of the package lid the height of the bottle and especially that of the protruding collar round the bottle neck can be limited as desired. Thirdly, according to FIG. 3, the slot provided in the lid for the bottle neck can be shaped so that it conforms to the shape of the bottle neck, thus preventing a bottle with a neck of a larger diameter from being placed in the slot. The advantage of selectivity is that bottles returned to a beverage manufacturer are of the same type as the beverage manufacturer's own bottles, and thus removal of other manufacturers' bottles from the production will not constitute a problem.

The package of the invention and its basic principles have been described above by means of some preferred embodiments and thus it is obvious that especially the appearance of the package may be modified in several ways without deviating from the inventive concept defined in the accompanying claims. According to this inventive concept the weight of the packages stacked one on top of the other is transmitted from the base of the packages to the bottles through the annular collar of the bottle necks and therethrough to the base of the lower package and further to the bottles in the lower layer through the annular collars provided on the bottles. Thus only the base of the package of the invention supports a pile of packages. Primarily for holding the bottles reliably in the package but also for increasing the stability of a package pile, the package also comprises a lid, which allows the bottles to be removed from the package only by slightly lifting the bottles from the base first.

What is claimed is:

1. A bottle package which allows bottles to be transported by carrying the bottles, the bottles comprising a bottom (1), body (2), neck (4) and mouth (5), of which the neck (3) comprises a projecting annular collar (4), the package comprising:

a base (6) for receiving and supporting the bottoms (1) of the bottles, the base comprising a seat (9) for each bottle to be placed on the base (6), on the surface away from the bottle seats (9) the base (6) comprising sockets (10) for receiving the mouths of the bottles and possible caps (5) up to the annular collar (4) of the bottle neck, the sockets being arranged centrally with respect to the bottle seats, whereby the packages stacked one on top of the other rest on the collars (4) of the bottles in the lower layer of packages, a frame and a handle (7,8) which are attached to the base and enable carrying of the package, and a lid (13) which is attached to the frame and handles (7,8) and is substantially parallel to the base (6) at the height of the bottle necks (3), the lid being provided with slots (14) which open towards the edge of the lid and receive the bottle necks, and with protrusions (15) at the edges of the slots, the protrusions acting together with the annular collar (4) of the bottle necks (3) and preventing a bottle placed in the package from tilting in the opening direction of the slot (14).

2. A package according to claim 1, wherein, each of the sockets for receiving the bottle mouth and a possible cap comprise a sleeve (11) whose edge (12) away from the bottle seat (9) forms a countersurface to the annular collar (4) of the bottle neck.

3. A package according to claim 2, wherein the sleeve (11) is provided with an opening on the side of the bottle seat (9).

4. A package according to claim 2 wherein the sleeve is conical, tapering towards the bottle seat.

5. A package according to claim 1, wherein the bottle seat of the base comprises means (16) acting together with the bottom of a bottle and preventing a bottle placed in the package from moving in the direction of the plane of the base (13).

6. A package according to claim 1, wherein the edge of each slot (54) provided in the lid (53) comprises the protrusions (55) for preventing two bottles from tilting.

7. A package according to claim 6, wherein the protrusions (15, 55) comprise a substantially vertical step in the direction away from to the opening direction of the slot (14, 54).

8. A package according to claim 7, wherein the protrusions ramp toward the opening direction of the slot (14, 54).

* * * * *